US007131870B2

(12) United States Patent
Whiteman, Jr. et al.

(10) Patent No.: US 7,131,870 B2
(45) Date of Patent: Nov. 7, 2006

(54) ELECTRICAL CONNECTOR

(75) Inventors: Robert Neil Whiteman, Jr., Middletown, PA (US); Wayne Samuel Davis, Harrisburg, PA (US); Douglas Wade Glover, Dauphin, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/052,417

(22) Filed: Feb. 7, 2005

(65) Prior Publication Data

US 2006/0178025 A1 Aug. 10, 2006

(51) Int. Cl.
*H01R 13/648* (2006.01)

(52) U.S. Cl. ..... 439/608

(58) Field of Classification Search ..... 439/608, 439/607, 108

See application file for complete search history.

(56) References Cited

U.S. PATENT DOCUMENTS

| | | | | |
|---|---|---|---|---|
| 5,961,355 | A * | 10/1999 | Morlion et al. | 439/686 |
| 6,293,827 | B1 | 9/2001 | Stokoe | 439/608 |
| 6,379,188 | B1 * | 4/2002 | Cohen et al. | 439/608 |
| 6,409,543 | B1 * | 6/2002 | Astbury et al. | 439/608 |
| 6,503,103 | B1 * | 1/2003 | Cohen et al. | 439/608 |
| 6,652,318 | B1 | 11/2003 | Winings et al. | |
| 6,899,566 | B1 * | 5/2005 | Kline et al. | 439/608 |
| 2003/0092291 | A1 | 5/2003 | Lemke et al. | 439/65 |
| 2003/0220018 | A1 | 11/2003 | Winings et al. | 439/608 |
| 2005/0196987 | A1 * | 9/2005 | Shuey et al. | 439/108 |

FOREIGN PATENT DOCUMENTS

| | | |
|---|---|---|
| CA | 2 461 037 | 5/2001 |

* cited by examiner

*Primary Examiner*—Tulsidas C. Patel
*Assistant Examiner*—Phuongchi Nguyen

(57) ABSTRACT

An electrical connector includes a housing and a plurality of contact modules in the housing. Each contact module includes a mating edge and a mounting edge. Each mating and mounting edge has a row of contacts including signal and ground contacts arranged in one of a first and second pattern. Adjacent contact modules in the housing have a different one of the first and second patterns. The first and second patterns each include pairs of signal contacts and individual ground contacts arranged in an alternating sequence. Each mating edge contact is electrically connected to a corresponding mounting edge contact by signal conductors and ground conductors extending along a predetermined path within the contact module. Each ground conductor has a width transverse to the predetermined path that is substantially equal to a combined transverse width across a pair of signal conductors in an adjacent contact module. The ground conductor shields the pair of signal conductors in the adjacent contact module.

17 Claims, 10 Drawing Sheets

ELECTRICAL CONNECTOR

BACKGROUND OF THE INVENTION

The invention relates generally to electrical connectors and, more particularly, to an electrical connector for transmitting signals in differential pairs.

With the ongoing trend toward smaller, faster, and higher performance electrical components such as processors used in computers, routers, switches, etc., it has become increasingly important for the electrical interfaces along the electrical paths to also operate at higher frequencies and at higher densities with increased throughput.

In a traditional approach for interconnecting circuit boards, one circuit board serves as a back plane and the other as a daughter board. The back plane typically has a connector, commonly referred to as a header, that includes a plurality of signal pins or contacts which connect to conductive traces on the back plane. The daughter board connector, commonly referred to as a receptacle, also includes a plurality of contacts or pins. Typically, the receptacle is a right angle connector that interconnects the back plane with the daughter board so that signals can be routed between the two. The right angle connector typically includes a mating face that receives the plurality of signal pins from the header on the back plane, and contacts that connect to the daughter board.

At least some board-to-board connectors are differential connectors wherein each signal requires two lines that are referred to as a differential pair. For better performance, a ground contact is associated with each differential pair. The receptacle connector typically includes a number of modules having contact edges that are at right angles to each other. The modules may or may not include a ground shield. As the transmission frequencies of signals through these connectors increase, it becomes more desirable to maintain a desired impedance through the connector to minimize signal degradation. A ground shield is sometimes provided on the module to reduce interference or crosstalk. In addition, a ground shield may be added to the ground contacts on the header connector. Improving connector performance and increasing contact density to increase signal carrying capacity without increasing the size of the connectors is challenging.

Some older connectors, which are still in use today, operate at speeds of one gigabit per second or less. By contrast, many of today's high performance connectors are capable of operating at speeds of up to ten gigabits or more per second. As would be expected, the higher performance connector also comes with a higher cost.

A need remains for a low cost differential connector with improved electrical characteristics such as reduced crosstalk and increased throughput.

BRIEF DESCRIPTION OF THE INVENTION

In one aspect, an electrical connector is provided that includes a housing and a plurality of contact modules in the housing. Each contact module includes a mating edge and a mounting edge. Each mating and mounting edge has a row of contacts including signal contacts and ground contacts arranged in one of a first and second pattern. Adjacent contact modules in the housing have a different one of the first and second patterns. The first and second patterns each include pairs of signal contacts and individual ground contacts arranged in an alternating sequence. Each mating edge contact is electrically connected to a corresponding mounting edge contact by signal conductors and ground conductors extending along a predetermined path within the contact module. Each ground conductor has a width transverse to the predetermined path that is substantially equal to a combined transverse width across a pair of signal conductors in an adjacent contact module. The ground conductor thereby shields the pair of signal conductors in the adjacent contact module when the contact modules are arranged in the housing.

Optionally, each contact module further includes transition regions that join each signal and ground contact to one of the conductors. The ground conductors may include a slot extending longitudinally between the transition regions. Alternatively, the ground conductors may include a plurality of slots extending longitudinally between the transition regions, wherein the plurality of slots define a plurality of reinforcing bars therebetween.

In another aspect, an electrical connector is provided that includes a housing and a plurality of contact modules in the housing. The contact modules carry differential signals. Each contact module includes a mating edge and a mounting edge. Each mating and mounting edge has a row of contacts including signal contacts arranged in differential pairs and individual ground contacts. The signal and ground contacts are arranged in one of a first and second pattern, and adjacent contact modules in the housing have a different one of the first and second patterns. The first and second patterns each include pairs of differential signal contacts and individual ground contacts arranged in an alternating sequence. Each mating edge contact is electrically connected to a corresponding mounting edge contact by signal conductors and ground conductors extending along a predetermined path within the contact module. The ground conductors in each contact module cooperate with ground conductors in adjacent contact modules to substantially isolate each differential signal conductor pair from other signal conductors to reduce crosstalk in the connector when the contact modules are arranged in the housing.

In yet another aspect, a lead frame for an electrical contact module is provided. The lead frame includes a first row of mating contacts defining a forward mating edge and a second row of mounting contacts defining a mounting edge. The row of mating contacts and mounting contacts each include signal contacts and ground contacts arranged in one of a first and second pattern. The first and second patterns each include pairs of signal contacts and individual ground contacts arranged in an alternating sequence. Each mating edge signal and ground contact is electrically connected to a corresponding mounting edge signal and ground contact by signal conductors and ground conductors extending along a predetermined path within the lead frame. Each ground conductor has a width transverse to the predetermined path that is substantially equal to a combined transverse width across a pair of signal conductors in an adjacent lead frame having contacts arranged in the other of the patterns. The ground conductor thereby shields the pair of signal conductors in the adjacent lead frame.

DETAILED DESCRIPTION OF THE INVENTION

Figure 1:
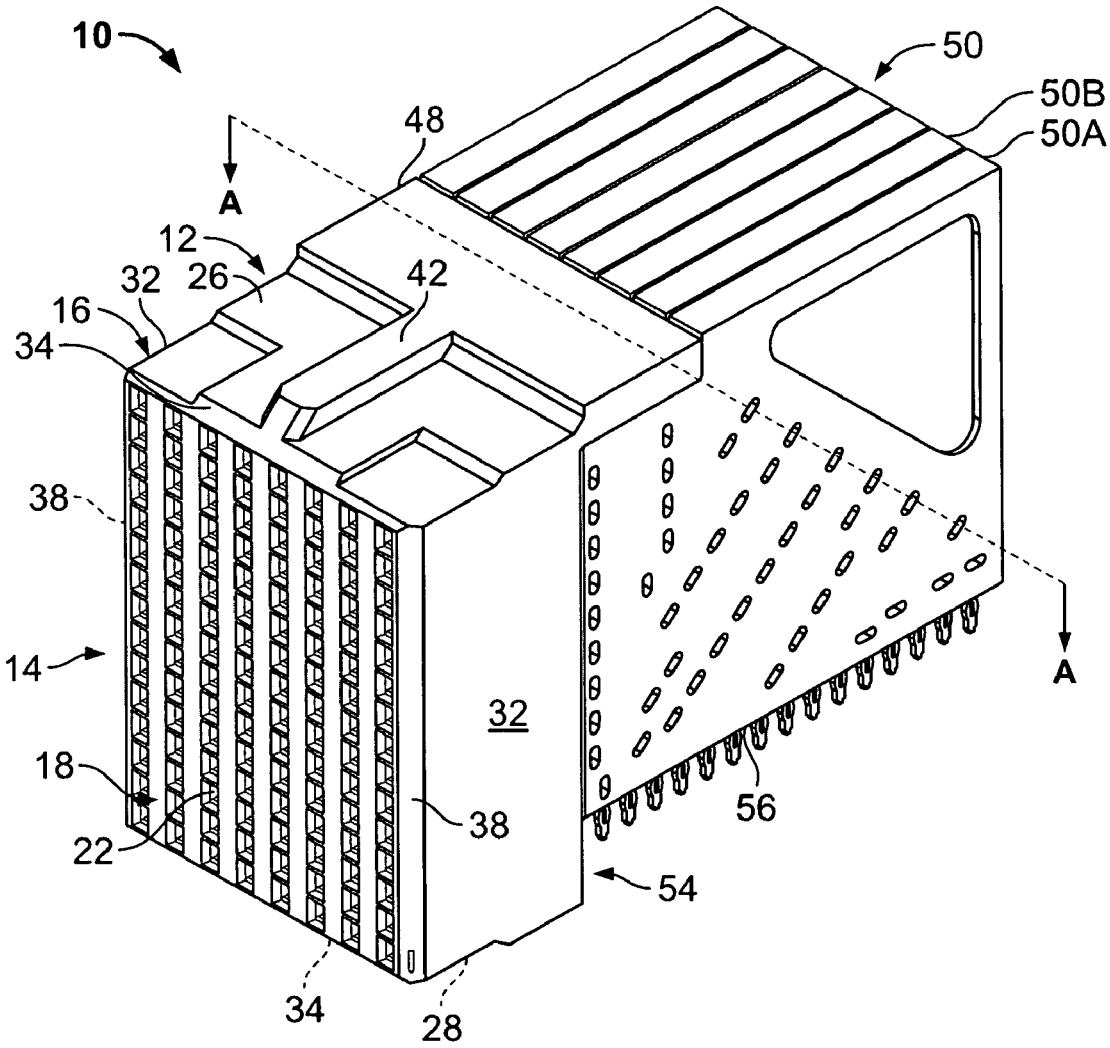
FIG. 1 is a perspective view of an electrical connector formed in accordance with an exemplary embodiment of the present invention.

FIG. 1 illustrates an electrical connector 10 formed in accordance with an exemplary embodiment of the present invention. While the connector 10 will be described with particular reference to a receptacle connector, it is to be understood that the benefits herein described are also applicable to other connectors in alternative embodiments. The following description is therefore provided for purposes of illustration, rather than limitation, and is but one potential application of the inventive concepts herein.

The connector 10 includes a dielectric housing 12 having a forward mating end 14 that includes a shroud 16 and a mating face 18. The mating face 18 includes a plurality of contact cavities 22 that are configured to receive mating contacts (not shown) from a mating connector (not shown). The shroud 16 includes an upper surface 26 and a lower surface 28 between opposed sides 32. The upper and lower surfaces 26 and 28, respectively, each includes a chamfered forward edge 34. The sides 32 each includes chamfered side edges 38. An alignment rib 42 is formed on the upper shroud surface 26 and lower shroud surface 28. The chamfered edges 34 and 38 and the alignment ribs 42 cooperate to bring the connector 10 into alignment with the mating connector during the mating process so that the contacts in the mating connector are received in the contact cavities 22 without damage.

The housing 12 also includes a rearwardly extending hood 48. A plurality of contact modules 50 are received in the housing 12 from a rearward end 54. The contact modules 50 define a connector mounting face 56. In an exemplary embodiment, the mounting face 56 is substantially perpendicular to the mating face 18 such that the connector 10 interconnects electrical components that are substantially at a right angle to one another. The contact modules 50 include two module types, 50A and 50B as will be described.

Figure 2:
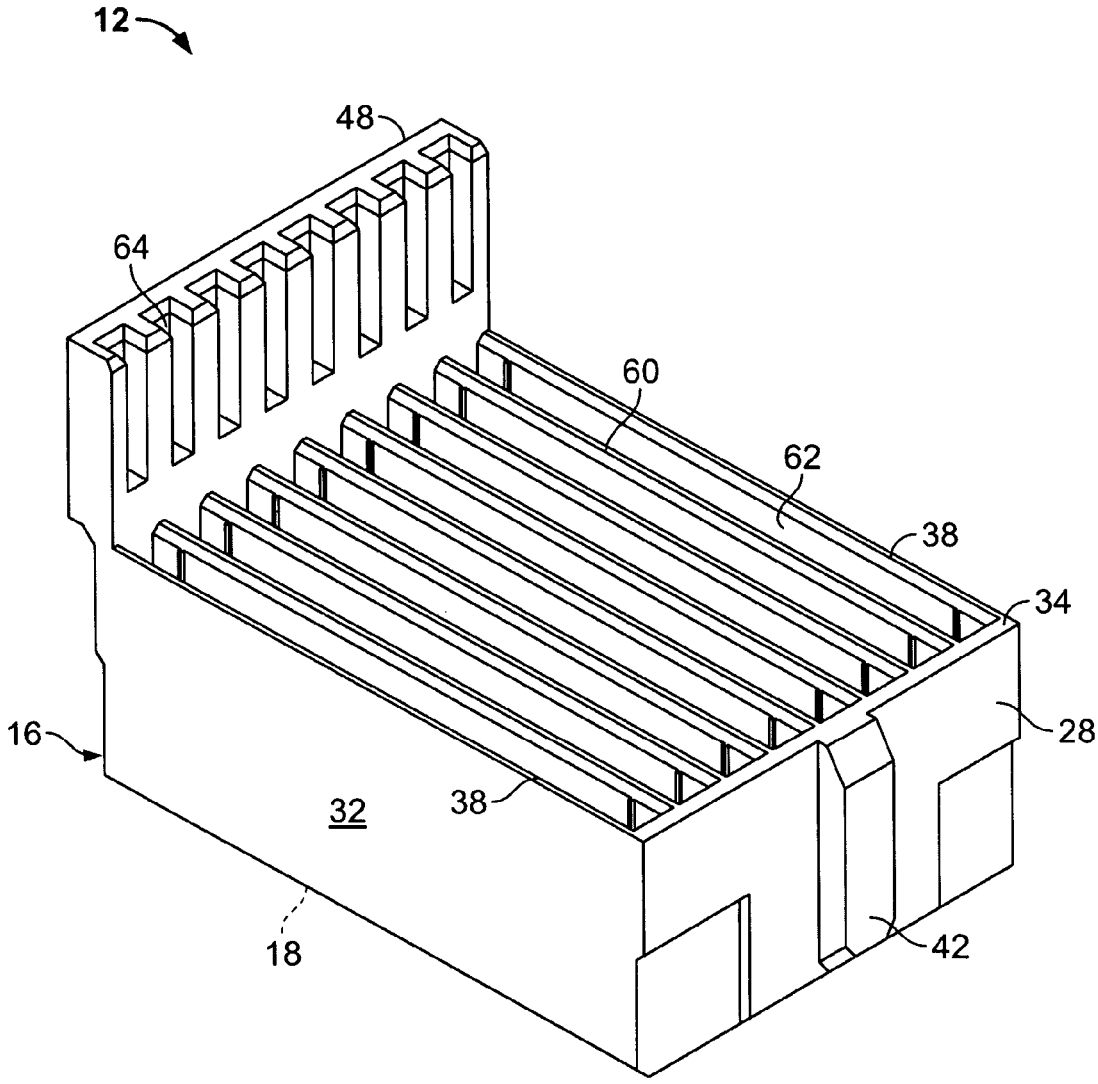
FIG. 2 is a rear perspective view of the housing of the connector shown in FIG. 1.

FIG. 2 illustrates a rear perspective view of the housing 12. The housing 12 includes a plurality of dividing walls 60 that define a plurality of chambers 62. The chambers 62 receive a forward portion of the contact modules 50 (FIG. 1). A plurality of slots 64 are formed in the hood 48. The chambers 62 and slots 64 cooperate to stabilize the contact modules 50 when the contact modules 50 are loaded into the housing 12.

Figure 3:
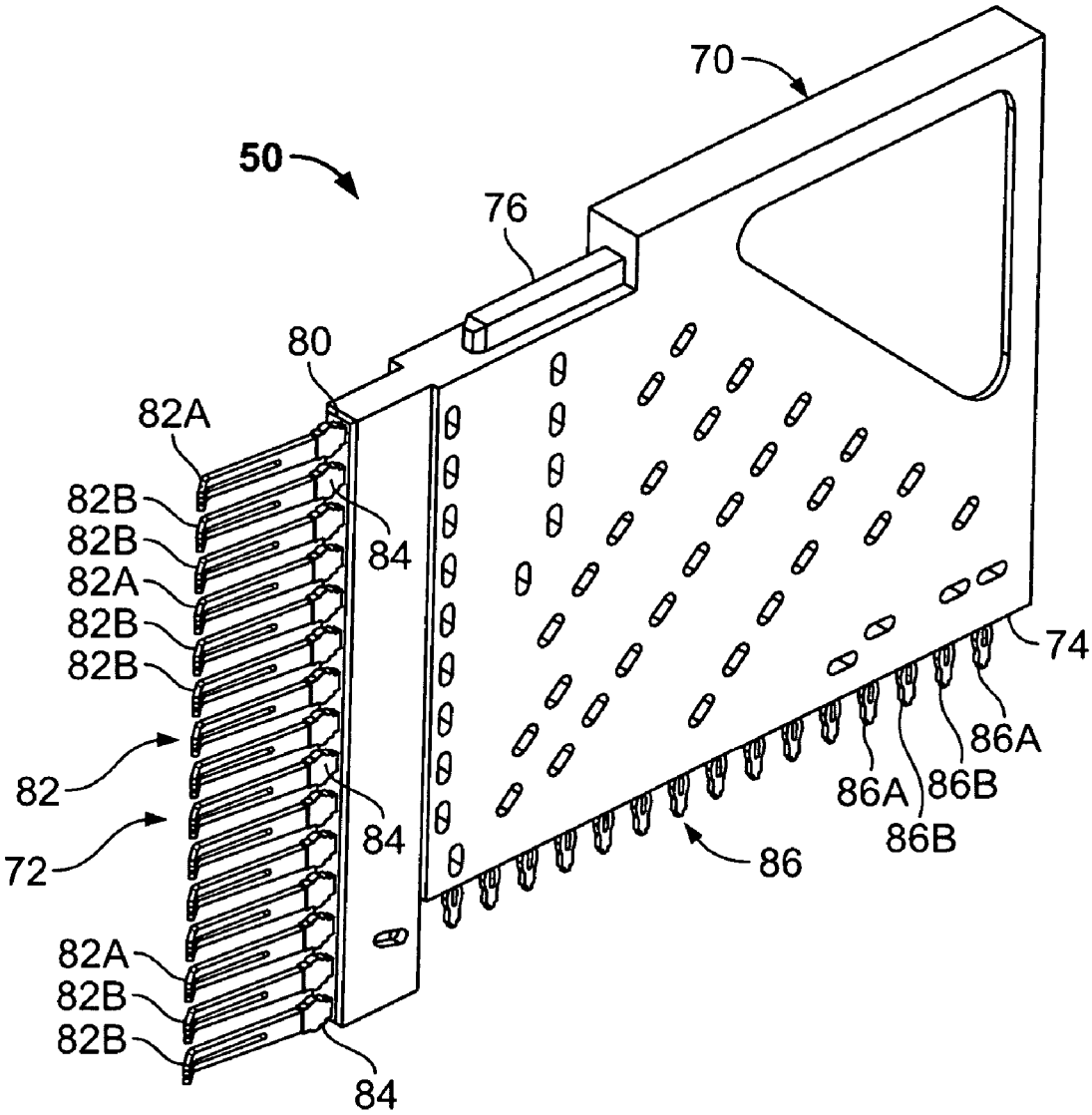
FIG. 3 is a perspective view of a contact module formed in accordance with an exemplary embodiment of the present invention.

FIG. 3 illustrates a perspective view of a contact module 50 formed in accordance with an exemplary embodiment of the present invention. The contact module 50 includes a lead frame (not shown in FIG. 3) that is over-molded in a dielectric housing 70. The contact module 50 has a forward mating end 72 and a mounting edge 74. The housing 70 includes an alignment rib 76 formed proximate the mating end 72. The mating end 72 is received in one of the chambers 62 in the housing 12 (FIG. 2). The alignment rib 76 is sized to be received in one of the slots 64 in the housing 12. The mating end 72 of the contact module 50 includes a mating edge 80 that holds a linear row of mating contacts 82. Each of the mating contacts 82 extends from a retaining bump 84 proximate the mating edge 80. The retaining bumps 84 engage interior webs (not shown) in the housing 12 proximate the mating end 14 to retain the contact module 50 in the housing 12. In one embodiment, the mating contacts 82 are spring contacts. However, other contact configurations may be used in other embodiments.

A row of mounting contacts 86 extend along the contact module mounting edge 74. In an exemplary embodiment, the mounting contacts 86 are eye-of-the-needle contacts and are configured to be mounted to a circuit board (not shown). In other embodiments, the mounting edge 74 may be joined to an electrical component using other known contact types. Electrical paths within the contact module 50 interconnect the mating and mounting contacts 82 and 86 respectively. In an exemplary embodiment, the mating edge 80 and the mounting edge 74 are substantially perpendicular to one another.

The mating contacts 82 and mounting contacts 86 include both signal and ground contacts arranged in one of a first and second pattern that each includes pairs of signal contacts and individual ground contacts arranged in an alternating sequence. For example, in the first pattern, mating contacts 82A are ground contacts and contacts 82B are signal contacts. Similarly, along the mounting edge 74, mounting contacts 86A are ground contacts and mounting contacts 86B are signal contacts. Conductors within the contact module 50 interconnect mating ground and signal contacts 82A and 82B, respectively, with corresponding ground and signal mounting contacts 86A and 86B, respectively. The pairs of adjacent signal contacts 82B and 86B, at the mating edge 80 and the mounting edge 74, respectively, form a differential signal pair carrying differential signals. In the second contact pattern, the contacts 82 and 86 are arranged such that the two uppermost mating contacts in FIG. 3 would both be signal contacts and the third, a ground contact. Similarly, the two rightmost mounting contacts would be signal contacts, and the third, a ground contact. From its outward appearance, the particular contact pattern in the contact module 50 cannot be discerned.

Figure 4:
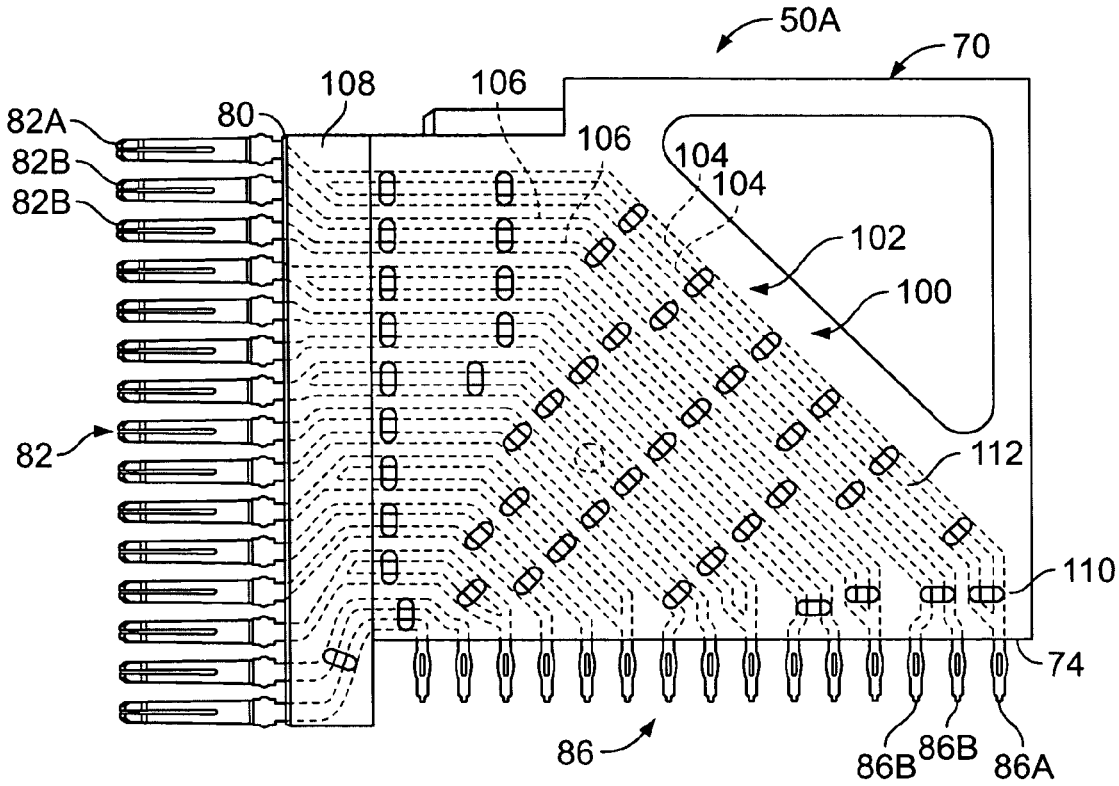
FIGS. 4 and 5 are side views of a contact module showing internal lead paths, in phantom outline, according to one embodiment of the present invention.

FIG. 4 is side view of a contact module 50A that includes an internal lead frame 100 shown in phantom outline. The lead frame 100 determines the contact pattern and thus characterizes the contact module 50A, which is in the first of the patterns described above. The lead frame 100 includes a plurality of conductors 102, including ground conductors 104 and signal conductors 106 that extend along predetermined paths to electrically connect each mating edge contact 82 to a corresponding mounting edge contact 86. A transition region 108 joins each mating contact 82 to one of the conductors 102 and a transition region 110 joins each mounting contact 86 to one of the conductors 102. In an exemplary embodiment, the ground conductors 104 have a longitudinally extending slot 112 that divides the ground conductor 104 into two parts between corresponding transition regions 108 and 110.

Figure 5:
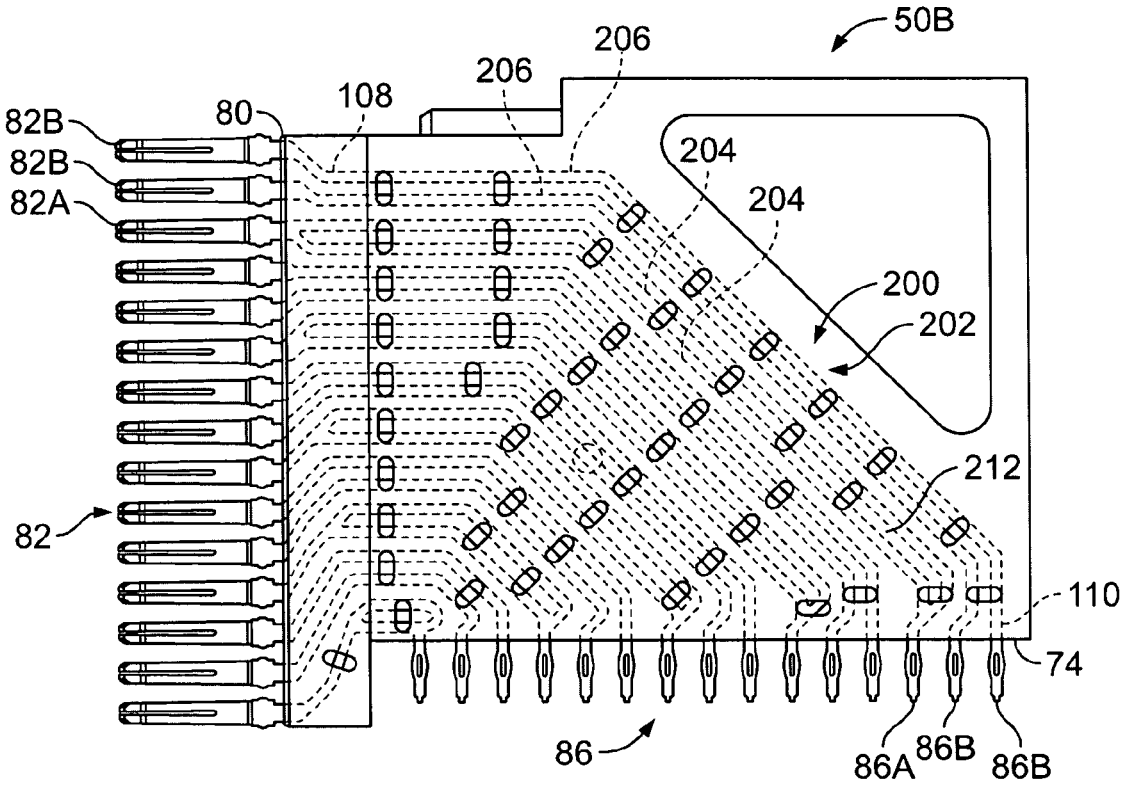

FIG. 5 is side view of a contact module 50B that includes an internal lead frame 200 shown in phantom outline. The lead frame 200 determines the contact pattern and thus characterizes the contact module 50B, which is in the second of the patterns previously described. The lead frame 200 is similar to the lead frame 100 (FIG. 4) and includes a plurality of conductors 202, including ground conductors 204 and signal conductors 206 that extend along predetermined paths to electrically connect each mating edge contact 82 to a corresponding mounting edge contact 86. Transition regions 108 and 110 join each mating contact and mounting contact, respectively, to one of the conductors 202. In an exemplary embodiment, the ground conductors 204 also have a longitudinally extending slot 212 that divides the ground conductor 204 into two parts between corresponding transition regions 108 and 110.

Figure 6:
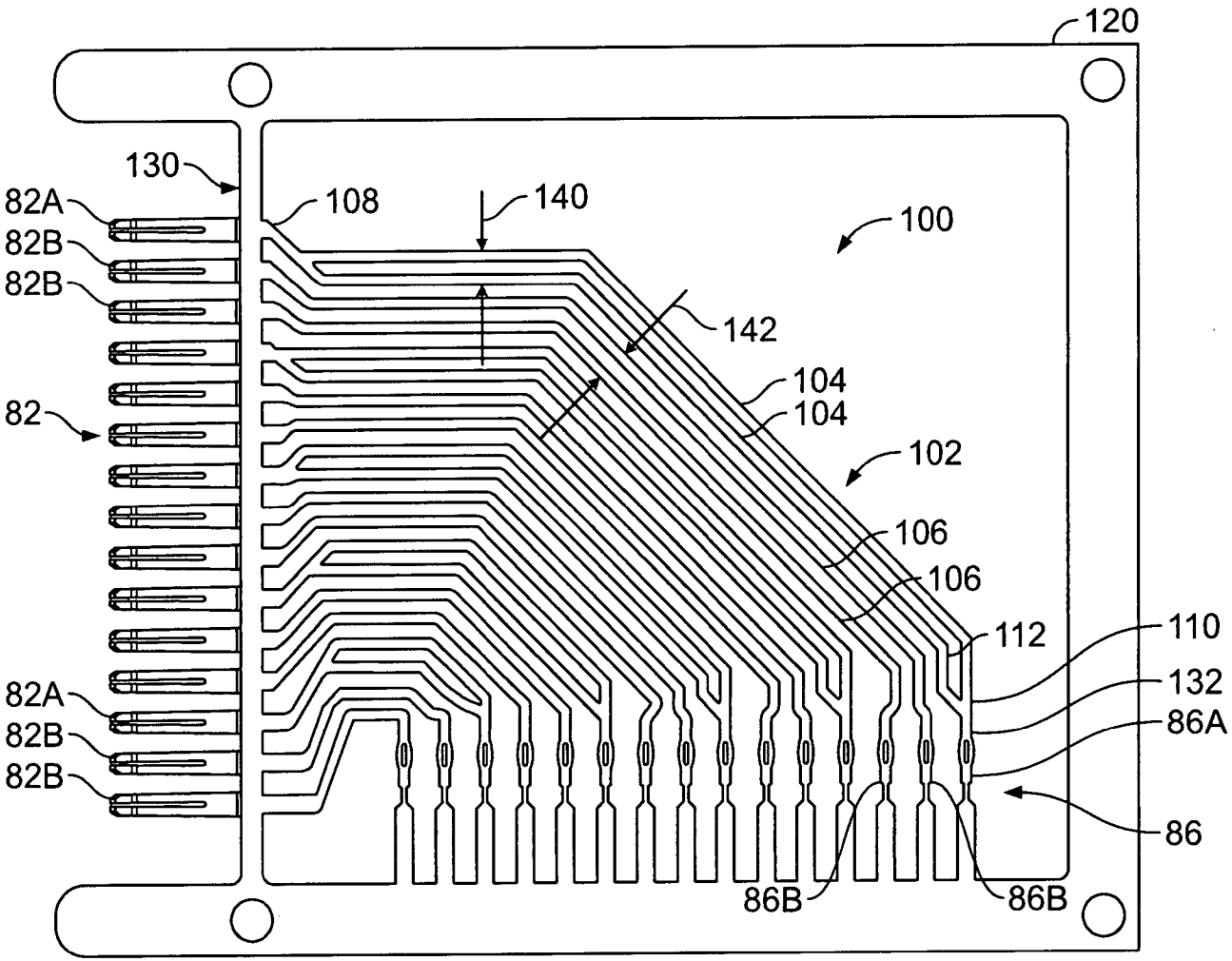
FIG. 6 is a side view of the lead frame in the contact module shown in FIG. 4.
Figure 7:
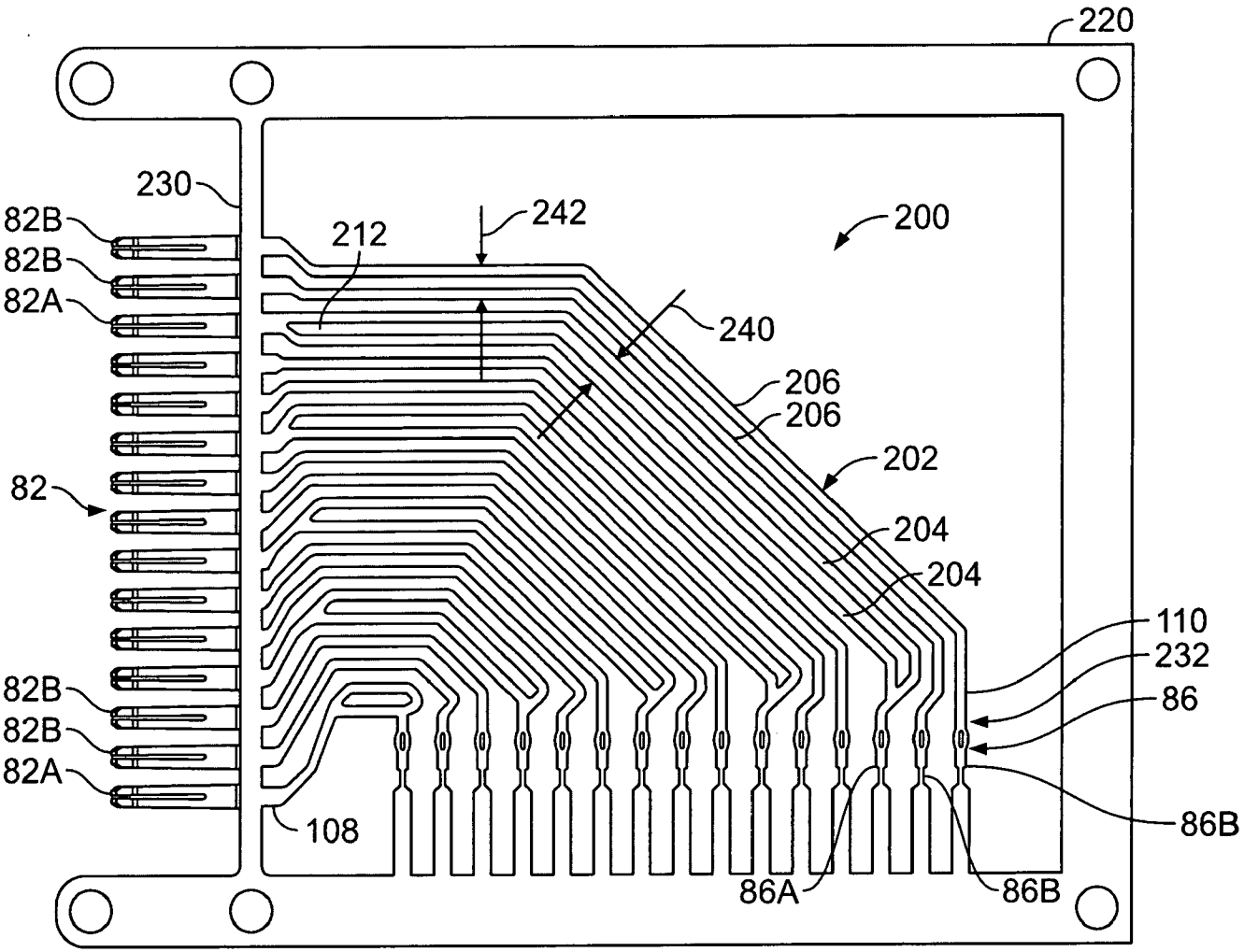
FIG. 7 is a side view of the lead frame in the contact module shown in FIG. 5.

FIG. 6 is a side view of the lead frame 100 that is used to form the contact module 50A. FIG. 7 is side view of the lead frame 200 that is used to form the contact module 50B. Each of the lead frames 100, 200 is shown attached to carrier strips 120 and 220, respectively, that are removed and discarded after the over-molding process that creates the contact modules 50A and 50B. The retaining bumps 84 (FIG. 3) are formed when the mating contacts 82 are cut from the carrier strips 120 and 220.

Lead frame 100 includes a first row of contacts 82 that are mating contacts and which define a forward mating edge 130 of the lead frame 100. A second row of contacts 86 are mounting contacts and define a mounting edge 132 of the lead frame 100. The mating contacts 82 and the mounting contacts 86 both include signal contacts 82B, 86B and ground contacts 82A, 86A arranged in a first pattern that includes pairs of signal contacts 82B, 86B and individual ground contacts 82A, 86A, arranged in an alternating sequence as previously described. The mating contacts 82 are electrically connected to corresponding mounting contacts 86 by conductors 102 that extend along predetermined paths between transition regions 108, 110 that join the conductors 102 to the contacts 82, 86. The conductors 102 are arranged in the lead frame 100 in the same pattern as the contacts 82 and 86 in the lead frame 100.

Lead frame 200 is similar to the lead frame 100 and includes a first row of contacts 82 that are mating contacts and which define a forward mating edge 230 of the lead frame 200. A second row of contacts 86 are mounting contacts and define a mounting edge 232 of the lead frame 200. The mating contacts 82 and the mounting contacts 86 both include signal contacts 82B, 86B and ground contacts 82A, 86A arranged in a second pattern. The pattern includes pairs of signal contacts 82B, 86B and individual ground contacts 82A, 86A, arranged in an alternating sequence as previously described. The mating contacts 82 are electrically connected to corresponding mounting contacts 86 by conductors 202 that extend along predetermined paths between transition regions 108, 110 that join the conductors 202 to the contacts 82, 86. The conductors 202 are arranged in the lead frame 200 in the same pattern as the contacts 82 and 86 in the lead frame 200.

In the embodiments of FIGS. 6 and 7, the ground conductors 104, 204 include a longitudinally extending slot 112, 212, respectively, between the transition regions 108 and 110 which divides the ground conductors 104, 204 into two parts. The ground conductors 104, 204 have a width 140, 240 transverse to the longitudinal path of the ground conductors 104, 204 that is substantially equal to a combined transverse width 142, 242 of a pair of signal conductors 106, 206 in an adjacent lead frame 100, 200 in an adjacent contact module 50A, 50B. In this manner, the ground conductors 104, 204 shield the signal conductors 106, 206 in the adjacent lead frame 100, 200. Moreover, the slots 112, 212 are sized such that each of the divided parts of the ground conductors 104, 204 is substantially equal in width to a width of an individual signal conductor 106, 206. However, in some embodiments, the size of the slots 112, 212 may be adjusted so as to maintain a desired impedance in the signal conductors 106, 206 in the lead frames 100, 200. Furthermore, in some embodiments, the widths 140, 240 of the ground conductors 104, 204 may vary along the length of the conductors 102, 202 depending on the configuration of the electrical paths within the lead frames 100, 200. The widths 140, 240 of the ground conductors 104, 204 may also be varied to maintain a desired impedance in the signal conductors 106, 206 in the lead frames 100, 200.

Figure 8:
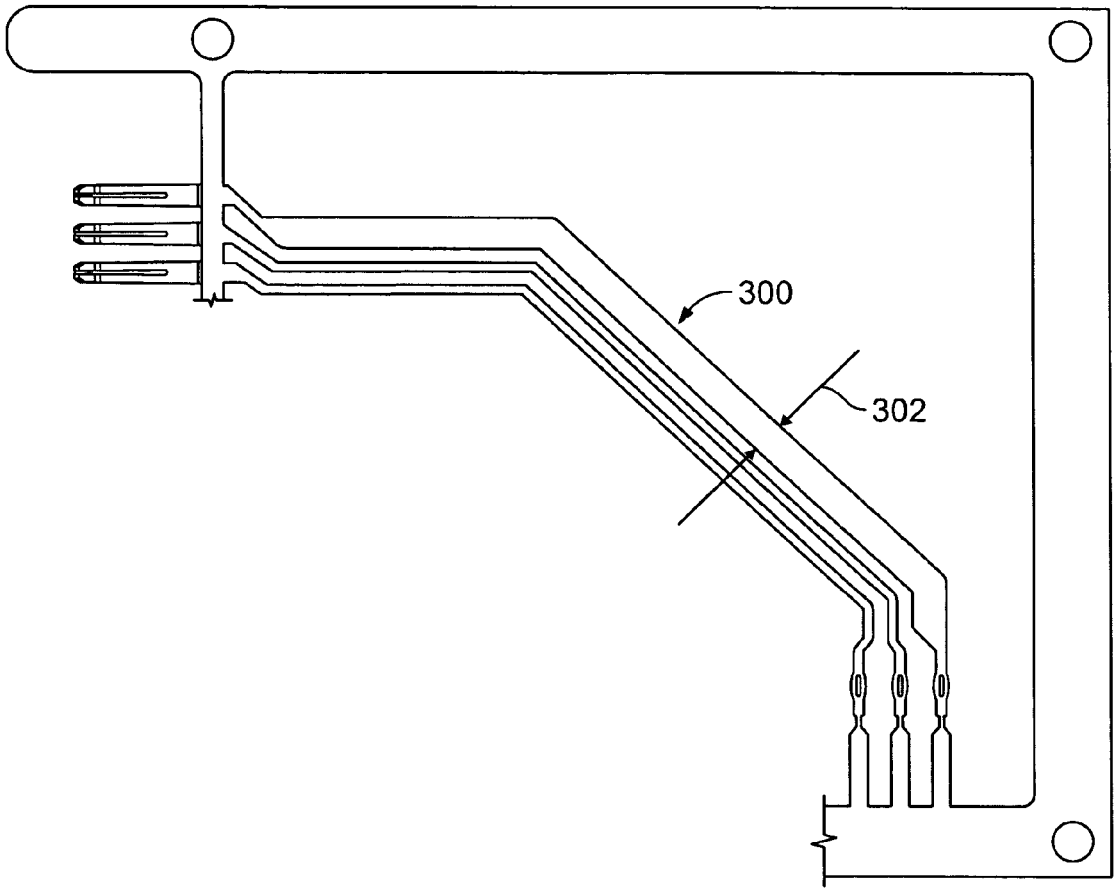
FIG. 8 is a side view of a partial lead frame illustrating a ground conductor formed in accordance with an alternative embodiment of the present invention.

FIG. 8 illustrates an alternative embodiment of a ground conductor 300 that is a solid lead of conductive material such as copper. The solid ground conductor 300 has a width 302 transverse to the longitudinal path of the ground conductor 300 that is substantially equal to a combined transverse width of a pair of adjacent signal conductors (not shown) in an adjacent lead frame (not shown).

Figure 9:
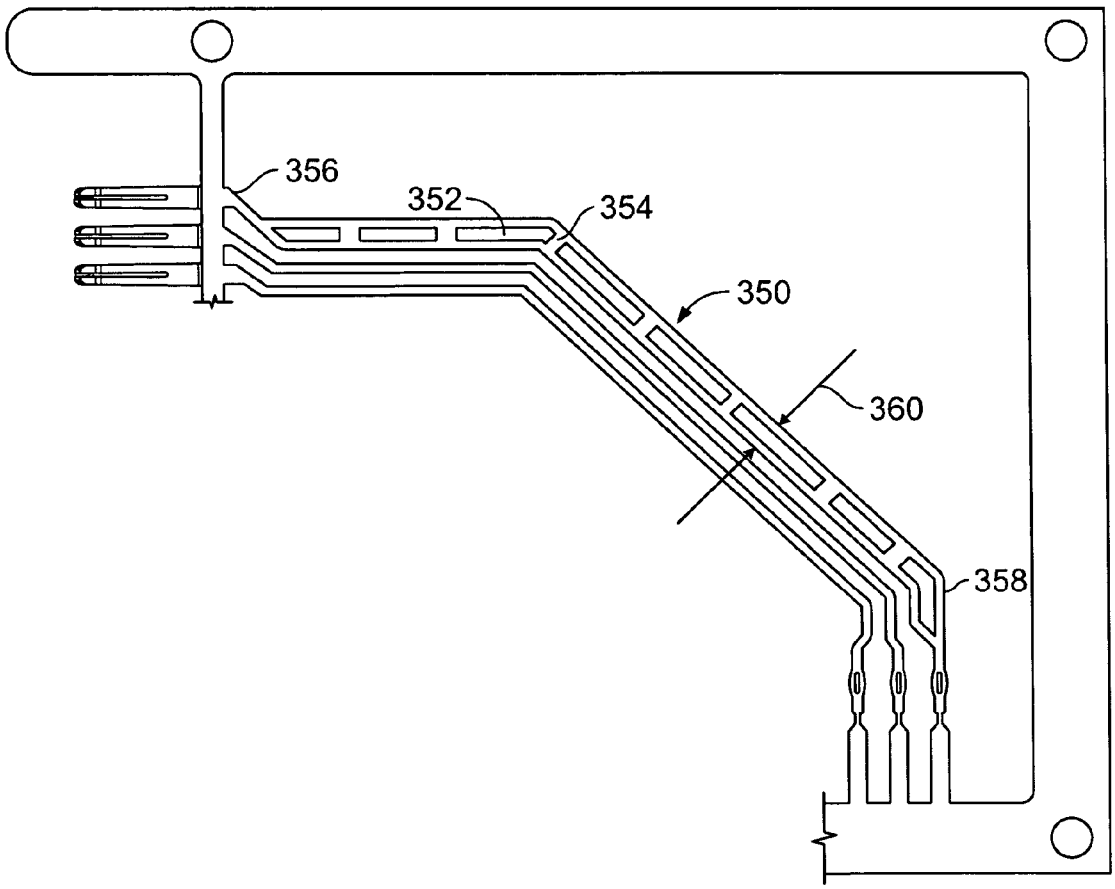
FIG. 9 is a side view of a partial lead frame illustrating a ground conductor formed in accordance with another alternative embodiment of the present invention.

FIG. 9 illustrates another alternative embodiment of a ground conductor 350 that includes a plurality of slots 352 between reinforcing bars 354 along a length of the ground conductor 350 between transition regions 356 and 358. The ground conductor 350 also has a width 360 transverse to the longitudinal path of the ground conductor 350 that is substantially equal to a combined transverse width of a pair of adjacent signal conductors (not shown) in an adjacent lead frame (not shown).

Figure 10:
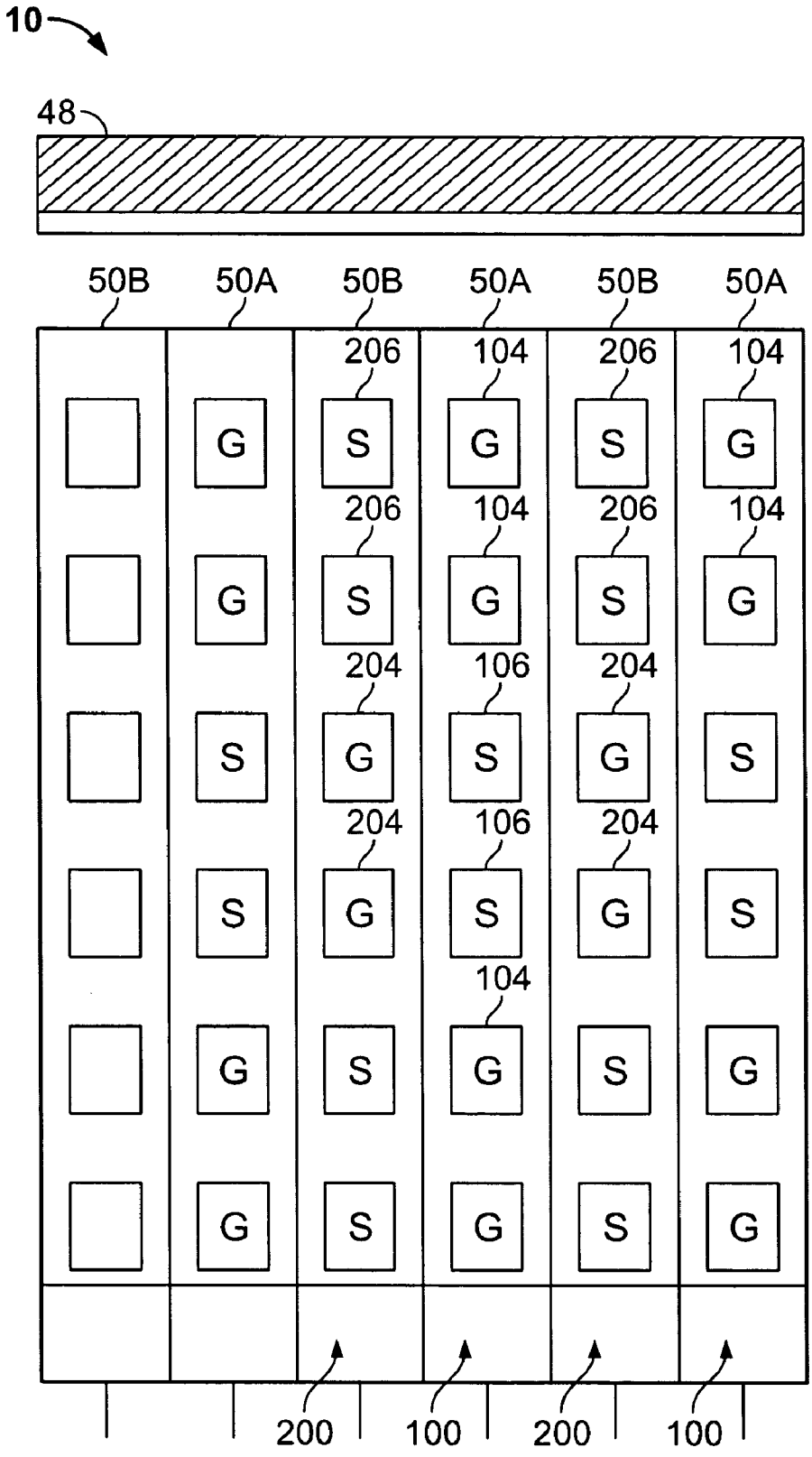
FIG. 10 is a partial cross sectional view of the connector shown in FIG. 1 taken along the line A—A.

FIG. 10 illustrates a partial cross sectional view of the connector 10 taken along the line A—A in FIG. 1. Certain of the conductors are labeled S (signal) or G (ground) to aid in identifying the conductors. The contact modules 50A, including the lead frame 100, and 50B, including the lead frame 200, are loaded into the housing 12 (FIG. 1) in an alternating sequence when the connector 10 is assembled such that the lead frames 100, 200 in adjacent contact modules 50A, 50B have different contact patterns, and more importantly different conductor patterns. Specifically, the lead frames 100 and 200 are configured such that, when the contact modules 50A, 50B are loaded in the housing 12, the signal conductors 106 in each of the lead frames 100 are spacially aligned with a ground conductor 204 in an adjacent lead frame 200 of the adjacent contact module 50B. Likewise, the signal conductors 206 in each of the lead frames 200 are spatially aligned with a ground conductor 104 in an adjacent lead frame 100 of the adjacent contact module 50A. In this manner, the signal conductors 106, 206, which are arranged in differential pairs, are shielded by adjacent ground conductors 104, 204 to reduce crosstalk in the connector 10 and facilitate increased throughput through the connector 10. Further shielding for the signal conductors 106, 206 is provided by ground conductors 104, 204 above and below the signal conductors 106, 206 in the same lead frame 100, 200 which cooperate with the ground conductors 104, 204 in an adjacent lead frame 100, 200 in an adjacent contact module 50A, SOB to substantially isolate each differential signal pair from other differential signal pairs in the connector 10.

The embodiments herein described provide an electrical connector 10 having an improved lead frame 100, 200 for carrying differential signals. The lead frame includes ground conductors 104, 204 that have a transverse width that is substantially equal to a combined width of a pair of signal conductors 106, 206 in an adjacent lead frame. The ground conductor shields the signal conductors to reduce crosstalk in the connector. The lead frame also allows the connector to operate at higher frequencies with increased throughput.

While the invention has been described in terms of various specific embodiments, those skilled in the art will recognize that the invention can be practiced with modification within the spirit and scope of the claims.

What is claimed is:

1. An electrical connector comprising:

a housing; and a plurality of contact modules in said housing;

each said contact module comprising a mating edge and a mounting edge, each said mating and mounting edges having a row of contacts including signal contacts and ground contacts arranged in one of a first and second pattern, and adjacent contact modules in said housing having a different one of said first and second patterns;

said first and second patterns each including pairs of signal contacts and individual ground contacts arranged in an alternating sequence;

each mating edge contact being electrically connected to a corresponding mounting edge contact by signal conductors and ground conductors extending along a predetermined path within said contact module;

wherein each said ground conductor has a width transverse to said predetermined path that is substantially equal to a combined transverse width across a pair of signal conductors in an adjacent contact module, said ground conductor thereby shielding said pair of signal conductors in said adjacent contact module when said contact modules are arranged in said housing.

2. The connector of claim 1, wherein each said contact module further includes transition regions that join each said signal and ground contact to one of said conductors.

3. The connector of claim 1, wherein each said contact module further includes transition regions that join each said signal and ground contact to a respective signal conductor and ground conductor and wherein said ground conductors include a slot extending longitudinally between said transition regions.

4. The connector of claim 1, wherein each said contact module further includes transition regions that join each said signal and ground contact to a respective signal conductor and ground conductor and wherein said ground conductors include a plurality of slots extending longitudinally between said transition regions, said plurality of slots defining a plurality of reinforcing bars therebetween.

5. The connector of claim 1, wherein said pairs of signal contacts and signal conductors carry differential signals.

6. The connector of claim 1, wherein each of said plurality of contact modules is received in one of a linear row of chambers in said housing.

7. The connector of claim 1, wherein said mating edge and said mounting edge in each contact module are substantially perpendicular to each other.

8. An electrical connector comprising:

a housing; and a plurality of contact modules in said housing, said contact modules carrying differential signals;

each said contact module comprising a mating edge and a mounting edge, each said mating and mounting edges having a row of contacts including signal contacts arranged in differential pairs and individual ground contacts, said signal and ground contacts being arranged in one of a first and second pattern, and adjacent contact modules in said housing having a different one of said first and second patterns;

said first and second patterns each including pairs of differential signal contacts and individual ground contacts arranged in an alternating sequence;

each mating edge contact being electrically connected to a corresponding mounting edge contact by signal conductors and ground conductors extending along a predetermined path within said contact module;

wherein said ground conductors in each said contact module cooperate with ground conductors in adjacent contact modules to substantially isolate each differential signal conductor pair from other signal conductors to reduce crosstalk in the connector when said contact modules are arranged in said housing; and wherein said signal and ground contacts and said signal and ground conductors in each said contact module comprise a lead frame, said lead frame including a plurality of retaining bumps that engage said housing to retain said contact module in said housing.

9. The connector of claim 8, wherein each said mating edge contact in said contact module extends from one of said retaining bumps.

10. The connector of claim 8, wherein each said ground conductor has a width transverse to said predetermined path that is substantially equal to a combined transverse width across a pair of signal conductors in an adjacent contact module, such that said ground conductor shields said pair of signal conductors in said adjacent contact module.

11. A lead frame for an electrical contact module, said lead frame comprising:

a first row of contacts comprising mating contacts and defining a forward mating edge; and a second row of contacts comprising mounting contacts and defining a mounting edge;

said row of mating contacts and mounting contacts each including signal contacts and ground contacts arranged in one of a first and second pattern;

said first and second patterns each including pairs of signal contacts and individual ground contacts arranged in an alternating sequence;

each mating edge signal and ground contact being electrically connected to a corresponding mounting edge signal and ground contact by signal conductors and ground conductors extending along a predetermined path within the lead frame;

wherein each said ground conductor has a width transverse to said predetermined path that is substantially equal to a combined transverse width across a pair of signal conductors in an adjacent lead frame having contacts arranged in the other of said patterns, said ground conductor thereby shielding said pair of signal conductors in said adjacent lead frame.

12. The lead frame of claim 11, wherein each said conductor includes transition regions that join said signal and ground contacts to said conductors.

13. The lead frame of claim 11, wherein each said conductor includes transition regions that join said signal and ground contacts to said conductors and wherein said ground conductors include a slot extending longitudinally between said transition regions.

14. The lead frame of claim 11, wherein each said conductor includes transition regions that join said signal and ground contacts to said conductors and wherein said ground conductors include a plurality of slots extending longitudinally between said transition regions, said plurality of slots defining a plurality of reinforcing bars therebetween.

15. The lead frame of claim 11, wherein each said ground conductor comprises a solid conductive lead.

16. The lead frame of claim 11, wherein said pairs of signal contacts and signal conductors carry differential signals.

17. The lead frame of claim 11, wherein said mating edge and said mounting edge in each contact module are substantially perpendicular to each other.

* * * * *